United States Patent [19]

Hansen

[11] Patent Number: 5,046,770

[45] Date of Patent: Sep. 10, 1991

[54] BAR LOCK MODULE AND ASSEMBLY SYSTEM

[75] Inventor: Randall C. Hansen, Lake Forest, Ill.

[73] Assignee: A. L. Hansen Manufacturing Co., Waukegan, Ill.

[21] Appl. No.: 643,555

[22] Filed: Jan. 18, 1991

[51] Int. Cl.[5] ..... E05C 9/08

[52] U.S. Cl. ..... 292/218; 292/DIG. 64

[58] Field of Search ..... 292/218, DIG. 32, DIG. 64, 292/DIG. 53; 29/526

[56] References Cited

U.S. PATENT DOCUMENTS

| | | | |
|---|---|---|---|
| 1,919,328 | 7/1933 | Hansen | 292/218 |
| 1,952,112 | 3/1934 | Bartsch | 292/218 |
| 1,955,653 | 4/1934 | Peremi et al. | 292/215 |
| 2,038,876 | 4/1936 | Sonabend | 292/215 |
| 2,402,241 | 6/1946 | Dath | 292/218 |
| 3,756,671 | 9/1973 | White | 292/218 X |
| 3,912,312 | 10/1975 | Cerutti | 292/218 |
| 4,127,291 | 11/1978 | Pelcin | 292/54 |
| 4,134,281 | 1/1979 | Pelcin | 70/208 |
| 4,660,872 | 4/1987 | Carson et al. | 292/242 |

*Primary Examiner*—Richard E. Moore

*Attorney, Agent, or Firm*—Willian Brinks Olds Hofer Gilson & Lione

[57] ABSTRACT

A bar lock includes one piece, preassembled latch modules. Each of the latch modules defines a rotatable shaft which supports a operating bar receiving socket at one end and a cam at the other. Each of the modules defines several locating elements which are used to locate and secure the preassembled module in place on a panel. The operating rod can be mechanically interlocked with the module to allow rapid and efficient assembly.

18 Claims, 3 Drawing Sheets

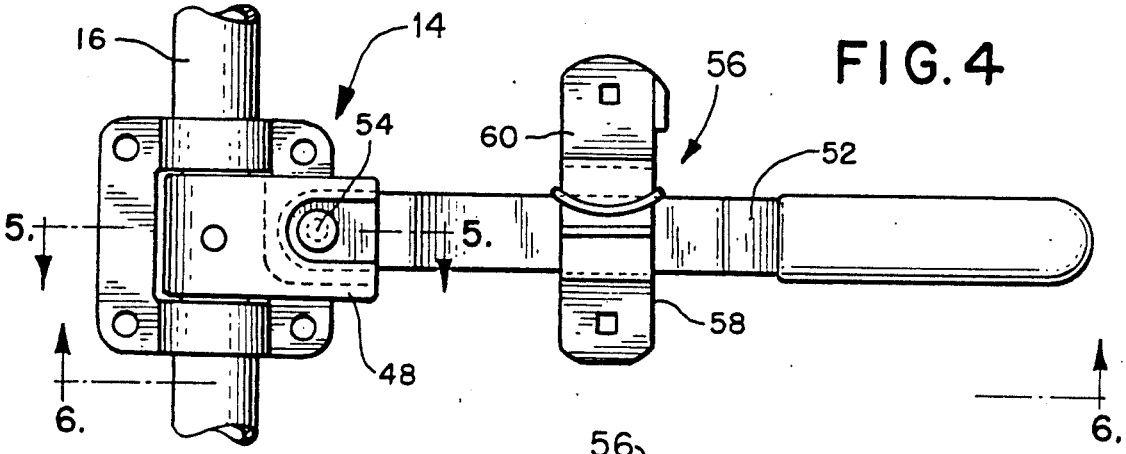
FIG. 4
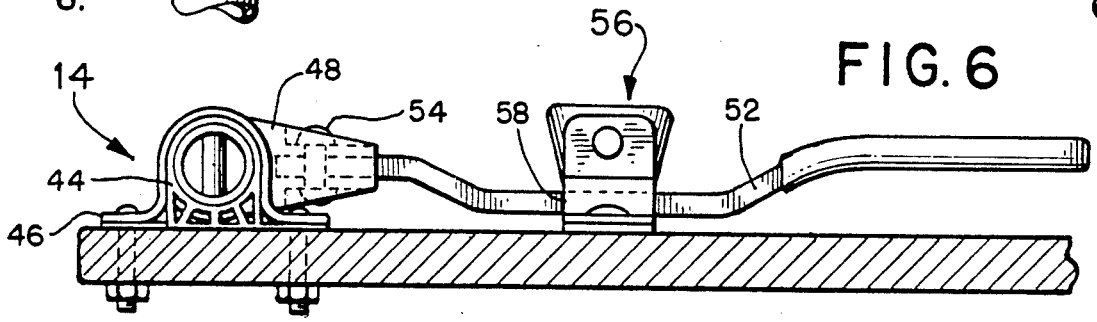
FIG. 6
FIG. 5
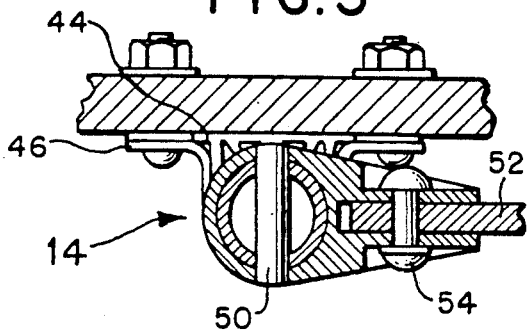
FIG. 7
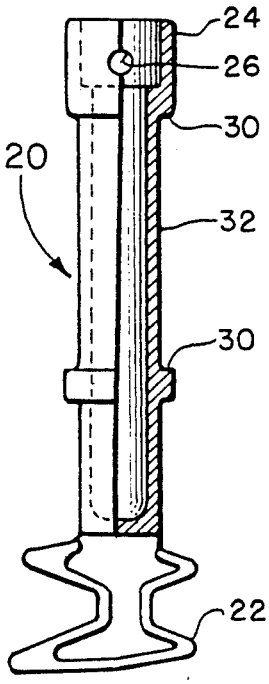
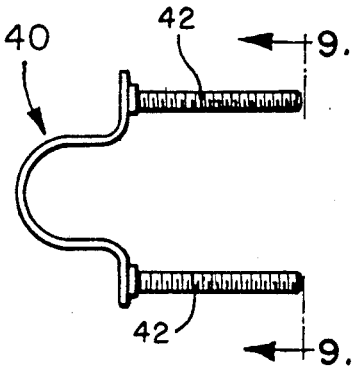
FIG. 8
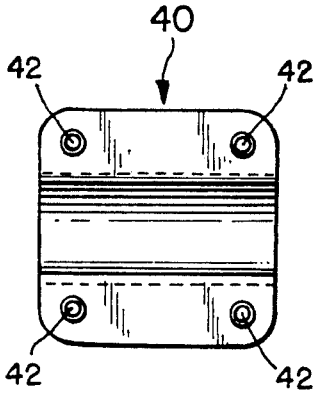
FIG. 9

FIG.11
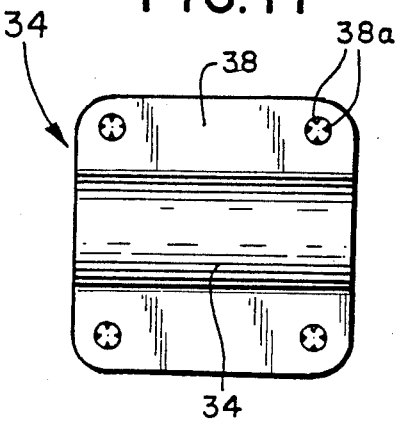
FIG.10
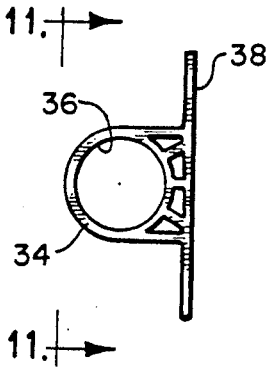
FIG.12
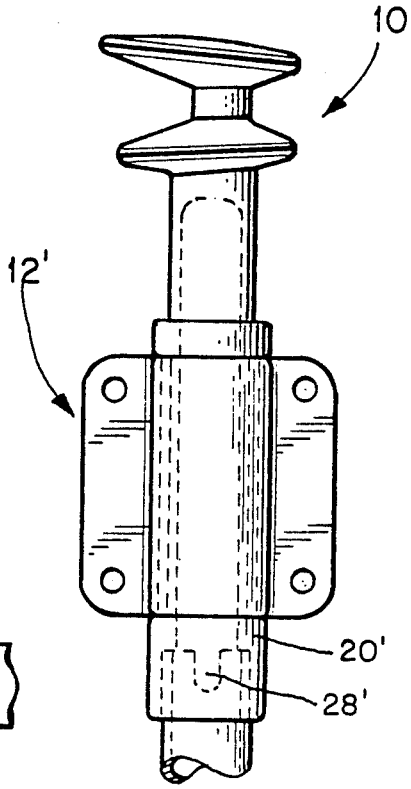
FIG.13
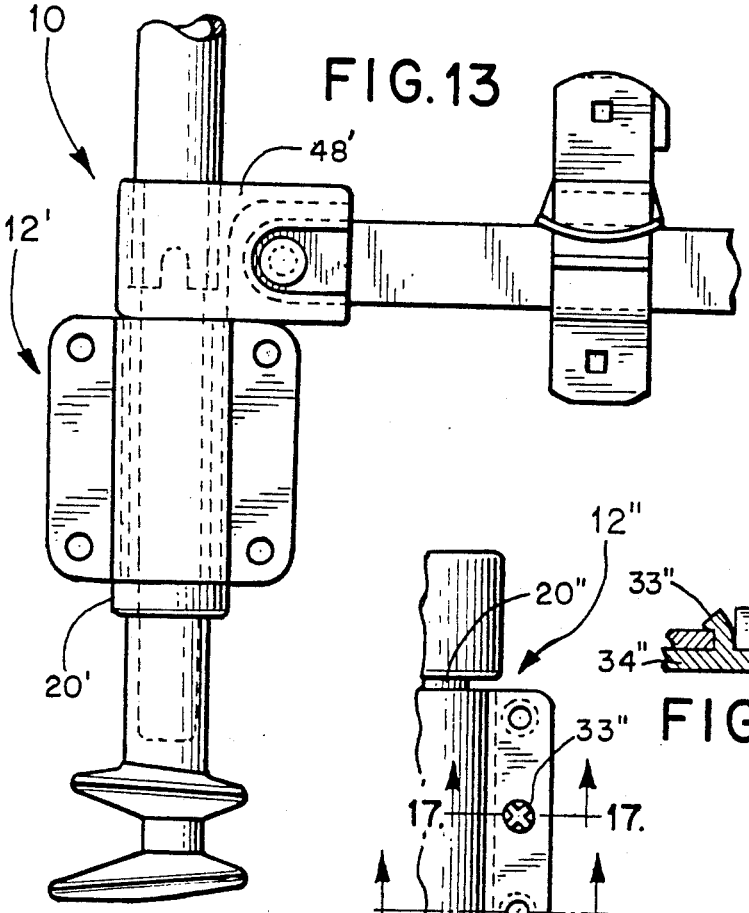
FIG.14
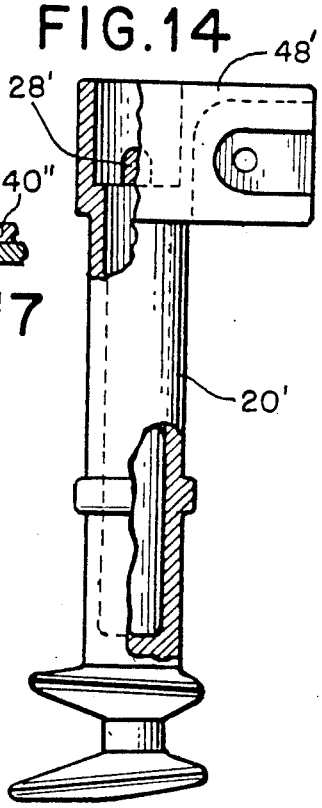
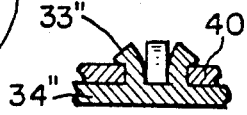
FIG.17
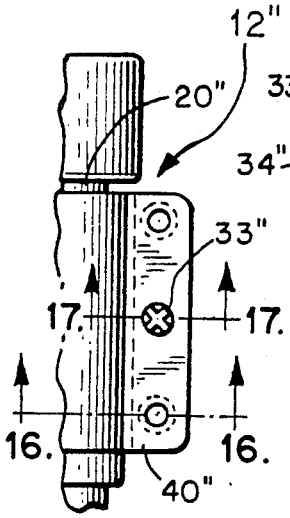
FIG.15
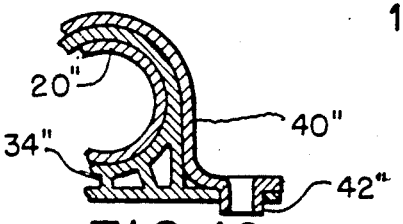
FIG.16

BAR LOCK MODULE AND ASSEMBLY SYSTEM

BACKGROUND OF THE INVENTION

This invention relates to bar locks of the type used to lock doors and other access panels on trailers, containers and the like, and to an improved method for assembling such bar locks.

Bar locks are in widespread use as closures for doors on semi-trailers, containers and the like. Cerutti U.S. Pat. No. 3,912,312 discloses one prior art bar lock which utilizes upper and lower latching elements that are individually journaled by bearings mounted by bolts onto the door or other movable panel. The journaled latching elements are rotated by an operating bar, and are welded to respective ends of the operating bar. A handle is secured to an intermediate portion of the operating bar to rotate the bar, and therefore the latching elements.

Prior art bar locks of the type disclosed in the Cerutti patent can be relatively cumbersome to install on the trailer or container. The bar lock is made up of a relatively large number of parts which must be separately handled and assembled by the installer. Furthermore, the upper and lower latching elements are welded to the operating bar. If these welds are made at the time of final assembly, there may be a need to regalvanize the operating bar to reduce corrosion. Alternately the latching elements and the operating bar may be welded together by the manufacturer. In this case, the fully assembled unit as shipped by the manufacturer is not well suited for modification to differing height doors. Furthermore, the fully assembled unit has a considerable length which makes it cumbersome and expensive to ship.

Bartsch U.S. Pat. No. 1,952,112 describes another type of bar lock in which the operating bar is square in section and is designed to fit into sockets formed by the upper and lower latch members. This approach allows the length of the operating bar to be adapted at the time of assembly to fit the particular application. However, the Bartsch bar lock is still formed of a unnecessarily large number of components which must be handled as separate units and assembled at the time the bar lock is installed on the trailer.

Pelson U.S. Pat. No. 4,127,291 discloses another bar lock in which one of the latching elements is welded in place to the operating bar, while the other is held in place by a bolt passing through a diametrically disposed hole in the bar. Once again, the bar lock of the Pelson patent is not well adapted for rapid installation.

Accordingly, it is an object of this invention to provide an improved bar lock and method for assembly that minimize the time required to install the bar lock on the trailer or other container.

It is another object of this invention to provide bar lock modules which can be shipped as preassembled units which are compact and relatively inexpensive to ship, and which can be easily and quickly assembled with other components at the time the bar lock is installed on the trailer or the container.

SUMMARY OF THE INVENTION

According to a first aspect of this invention, a bar lock latch module is provided which comprises a shaft having first and second ends. A bar lock latch is located on the first end of the shaft and means are provided on the second end of the shaft for releasably coupling the shaft to an elongated bar such that rotation of the bar causes rotation of the shaft and the latch. This coupling means comprises a keyed portion configured to mate with a complimentary keyed portion on the elongated bar. The module also comprises a mounting bracket having a mounting plate shaped to be secured to a panel and a bearing carried by the mounting plate and disposed around the shaft intermediate the two ends. The shaft is captured in the bearing such that the shaft is free to rotate in the bearing but is prevented from moving axially out of the bearing. Means are provided for securing the mounting plate and the bearing plate in place on the shaft prior to installation of the bar lock latch module such that the shaft, latch, coupling means and mounting bracket form a preassembled unit which is mountable on the panel as a single module to speed assembly of the bar lock.

According to the method of this invention, a bar lock latch module and an elongated bar of the type described above are provided, along with a panel having openings therein positioned to receive mounting fasteners. The bar lock latch module is mounted in place on the panel as a unit by positioning the mounting fasteners in the openings. The keyed portion of the shaft is interconnected with the complimentary keyed portion of the elongated bar and the bar lock latch module is secured in position on the panel.

Because of their modularized construction, the preferred embodiments described below can easily be installed by a single individual, thereby speeding and minimizing the cost of installation. Furthermore, the module itself is a compact, relatively high value item which can readily be shipped and stored. Finally, since the modules can easily be interconnected with appropriate operating bars, the user can stock the appropriate operating bars and the manufacturer can supply the same module to many end users having requirements for differing length bar locks.

BRIEF DESCRIPTION OF THE DRAWINGS

FIG. 4 is an enlarged view of a handle module included in the embodiment of FIG. 1.

FIG. 5 is a cross-sectional view taken along line 5—5 of FIG. 4.

FIG. 6 is a cross-sectional view taken along line 6—6 of FIG. 4.

FIG. 7 is an enlarged view of the latch and associated shaft of the latch module of FIG. 2.

FIG. 8 is an end view of a portion of the mounting bracket included in the latch module of FIG. 2.

FIG. 9 is a view taken along line 9—9 of FIG. 8.

FIG. 10 is an end view of another portion of the mounting bracket of FIG. 2.

FIG. 11 is a view taken along line 11—11 of FIG. 10.

FIG. 12 is an elevational view of a second preferred embodiment of the latch module of this invention.

FIG. 13 is an elevational view of a third preferred embodiment of the latch module of this invention.

FIG. 14 is an enlarged view of a portion of the latch module of FIG. 13.

FIG. 15 is an enlarged fragmentary elevational view of a third preferred embodiment of the latch module of this invention.

FIG. 16 is a cross sectional view taken along line 16—16 of FIG. 15.

FIG. 17 is a cross sectional view taken along 17—17 of FIG. 15.

DETAILED DESCRIPTION OF THE PRESENTLY PREFERRED EMBODIMENTS

Figure 1:
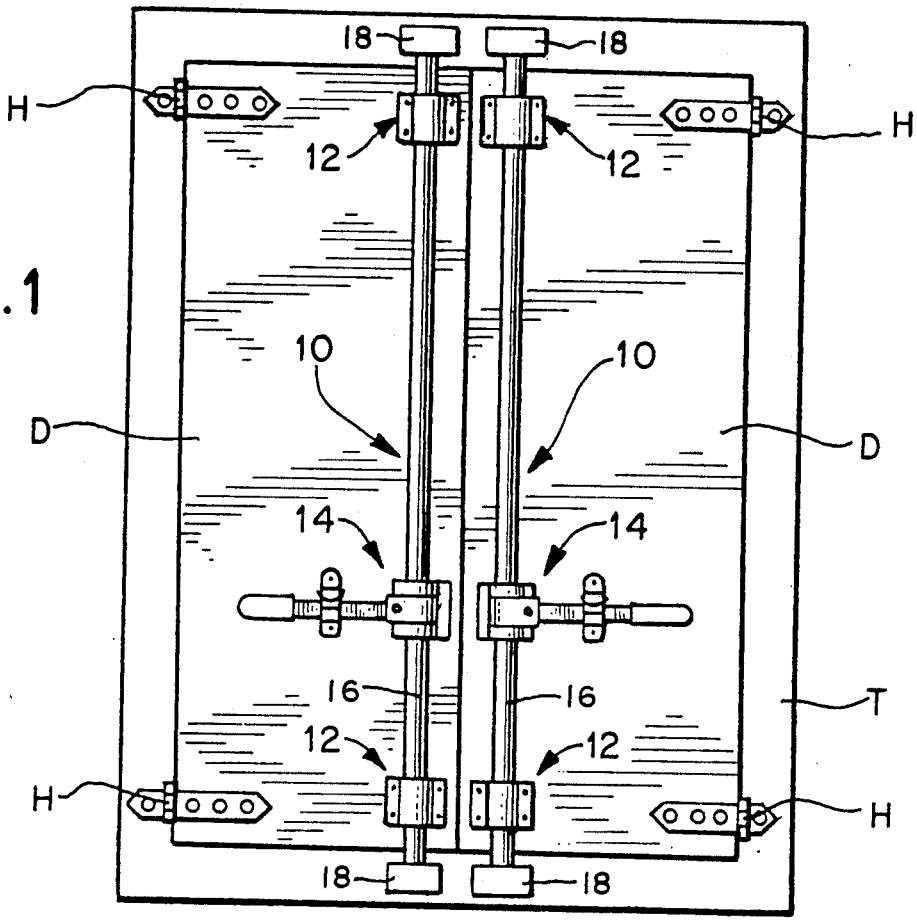
FIG. 1 is an elevational view of a portion of a trailer on which is mounted a first preferred embodiment of the bar lock of this invention.

Turning now to the drawings, FIG. 1 shows an elevational view of the doors D of a semi-trailer T. The doors D are mounted to the trailer T by hinges H in the conventional manner. As shown in FIG. 1, a pair of bar locks 10 are provided, each on a respective one of the doors D. The bar locks 10 comprise upper and lower latch modules 12, a handle module 14, and an operating bar 16 extending between the modules 12, 14. Each of the latch modules 12 includes at its outer end a cam (not shown in FIG. 1) designed to lock against a cam receiving block 18 rigidly mounted to the trailer T.

Figure 2:
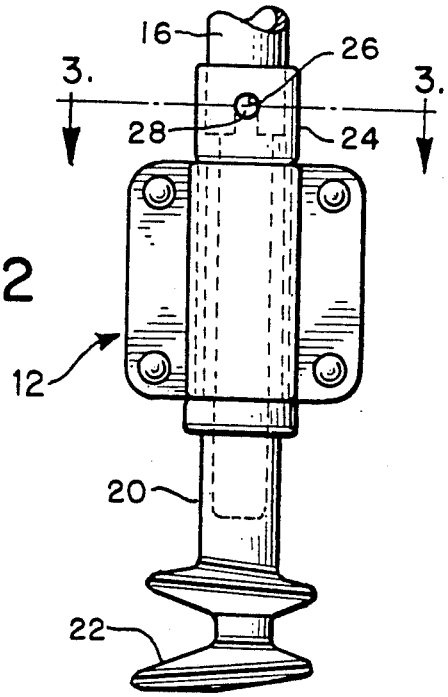
FIG. 2 is an enlarged view of a latch module included in the embodiment of FIG. 1.
Figure 3:
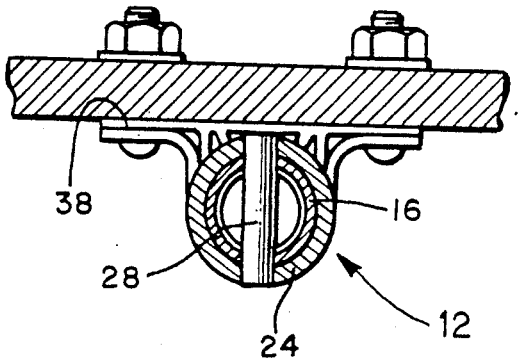
FIG. 3 is a cross-sectional view taken along 3—3 of FIG. 2.

FIGS. 2, 3 and 7–11 provide further details regarding the construction of the latch module 12. As shown in FIG. 7, each latch module 12 includes a shaft 20 having a first end that defines a latch 22 such as the illustrated cam and a second end which defines a socket 24. The socket 24 has a diametrical through hole 26 which supports a diametrically oriented pin 28 (FIG. 2). Returning to FIG. 7, the shaft 20 defines a pair of facing shoulders 30 and a journal 32 disposed therebetween.

The shaft 20 is supported by a bearing 34 which is best shown in FIGS. 10 and 11. The bearing 34 may for example be molded from a plastic material such as nylon 6. The bearing 34 defines a central opening 36 sized to surround the journal 32 and a bearing plate 38 used to secure the bearing 34 in position. The bearing 34 is sized to fit between the shoulders 30, and the shoulders 30 serve to capture the bearing 34 in position on the shaft 20.

The bearing 34 is sized to fit within a mounting plate 40 which is best shown in FIGS. 8 and 9. The mounting plate 40 is preferably formed from a sheet metal such as 10 gauge hot rolled steel. The mounting plate 40 supports four locating studs 42, which in this embodiment are threaded as shown in FIG. 8. Preferably, the locating studs 32 are welded in place directly onto the rear side of the mounting plate 40. Studs sold under the tradename "Weldstud" have been found suitable. The mounting plate 40 and bearing 34 together form a mounting bracket which is used as described below to secure the shaft 20 in position on the door D while allowing rotation.

FIGS. 4–6 depict the handle module 14. As best shown in FIG. 6, the handle module 14 includes a bearing 44 and mounting plate 46 which are similar to the components described above, except that they are provided with a cutout to receive a handle bracket 48. The handle bracket 48 is secured to the operating rod 16 by means of a diametrical pin 50. The handle bracket 48 supports at its outer end a handle 52 which is pivotably mounted to the handle bracket 48 by a fastener 54. The handle 52 is held in position on the door D by an assembly 56 that includes a lower shelf 58 and a locking member 60. The shelf 58 and locking member 60 operate in the conventional manner to allow the handle 52 to be locked in place against the door D. When the handle 52 is removed from the assembly 56, the handle 52 can be used to rotate the operating bar 16 in order to rotate the latches 22 to open or close the doors D.

FIG.s 12, 13 and 14 illustrate a second preferred embodiment of the bar lock of this invention. This second preferred embodiment 10′ includes a latch module 12′ which is similar to that described above, except that the shaft 20′ defines an integrally molded diametrical ridge 28′ which serves the function of the pin 28 described above. Also, the lower one of the latch modules 12′ defines an integral handle bracket 48′ which is formed on one end of the shaft 20′, as shown in FIG. 14.

The operating bar 16 is provided with notches 17 sized to receive the pin 28 or the ridge 28′. Thus, the pin 28 or ridge 28′ forms a keyed portion, and the notches 17 form a complimentary keyed portion. The socket 24 and the pin 28 or ridge 28′ form a means for releasably coupling the shaft 20, 20′ to the operating bar 16. Of course, this coupling function can be performed by a wide variety of structures. For example, the operating bar 16 can be provided with an internal or external shape which is out of round, and the shaft 20 can be provided with a protruding element that mates with the out of round surface on the operating bar 16.

FIG.s 15–17 illustrate portions of a third preferred embodiment of one of the latch modules of this invention. The latch module 12″ includes a shaft 20″ which may be identical to either of the shafts 20, 20′ described above. In addition, the module 12″ includes a bearing 34″ and a mounting plate 40″ which are generally similar to the elements 34, 40 described above, with the following exceptions.

First, the mounting plate 40″ supports four tubular locating sleeves 42″ (FIG. 15) instead of the studs 42 described above. These sleeves 42″ may be shear formed, and they perform two functions: they locate the module 12″ in suitable panel openings during assembly; and they receive fasteners (not shown) to secure the module 12″ in place.

Second, the bearing 34″ defines self locking protruding tabs 33″ which are received in aligned openings in the mounting plate 40″ (FIGS. 15 and 17) The tabs 33″ snap in place to secure the bearing 34″ and the mounting plate 34″ together, with the shaft 20″ captured therebetween.

The module 12″ is similar to the modules 12, 12′ in that it forms a preassembled unit which is mountable on the panel as described below as a single unit to speed assembly of a bar lock. It differs from the modules 12, 12′ in that it uses removable fasteners, it substitutes the locating sleeves 42″ for the locating studs 42, and it relies on the tabs 33″ to hold the module together.

ASSEMBLY METHOD

The bar lock modules 12, 12′, 12″ described above have been designed to minimize shipping and assembly costs. In order to assemble the bar lock 10 on the door D, the door D is first drilled with openings to receive the locating studs 42. The operating bar 16 is cut to length and provided with notches 17. The latch modules 12 form preassembled units which can be shipped and handled as a unit. Preferably, means are provided for retaining the bearing plates 38 on the locating studs 42. This can be done with simple retaining clips designed to snap against the threads on the locating studs 42. Alternately, the bearing plates 38 may be provided with projections 38*a* around the openings that receive the locating studs 42 to engage the threads on the studs 42 (FIG. 11). In either case, the entire module made up of the shaft 20, latch 22, socket 24, bearing 34, mounting plate 40 and locating studs 42 forms a single, preassembled unit.

The preassembled latch module 12 can simply be mounted in the previously formed openings in the door D by a single installer. The installer then interconnects the operating bar 16 with the installed latch module 12 by placing one end of the operating bar 16 in the socket 24 with the pin 28 or ridge 28' received in the notch 17. Then the handle module 14 is installed on the operating bar 16, and the handle module 14 is secured in place by positioning the respective locating studs in the openings of the door D. This process is then repeated for the upper latch module 12. Thus, the assembly is completed by stacking the various components, each of which is a preassembled unit that can be handled as a unit without dealing with a large number of component parts. As the modules 12, 14 are installed in place, they are secured in position by means of nuts threaded on the locating studs 42.

With respect to the second preferred embodiment 10', the preferred assembly method is as described above, except that there is no separately mounted latch module.

Because the locating studs 42 are secured in place in the modules 12, 12', 14, the modules can be located on the doors D by a single installer, without requiring the installer to handle a large number of separate parts. In this way, installation is simplified, and can be accomplished in little time.

The module 12'' of the third preferred embodiment 12'' is preferably installed in the same manner, except that separate fasteners are used to secure the module 12'' to the panel.

The bar locks described above provide the advantage that the manufacturer of the high value latch and handle modules 12, 12', 12'', 14 can ship these modules as preassembled units. In this way, the manufacturer avoids the cost and complexity of stocking and shipping a large number of different length operating bars 16. The user can easily provide the bar 16 in the desired length. In the event a bar 16 is erroneously cut to an incorrect length, it can easily be replaced without loss of the high value latch and handle modules 12, 12', 12'', 14. This flexibility is obtained without any welding during final assembly, and without the disadvantages caused by such welding. For example, when galvanized material is welded, regalvanizing may be required to reduce corrosion problems.

ALTERNATIVES

Of course, a wide variety of alternatives can be made to the preferred embodiments described above. As pointed out above, the mechanical interlock between the operating bar and the latch module can be formed in a variety of geometries, and the latch module can define either the male or the female half of the interlock. The latch 22 can be formed in any suitable configuration. In practice several different latch shapes are in common use, and the present invention can readily be adapted to any of them. The locating studs 42 do not have to be welded in place onto the mounting bracket, but can be held in place in other ways. For example, bolts can be used as long as they are held in place by a suitable keeper, and in appropriate situations an adhesive may be suitable. The bearing 34 does not have to be formed integrally with the bearing plate 38. In alternate embodiments the bearing may be formed as a tube which is held in place between opposed plates. A wide variety of materials are suitable for use with the present invention. The shaft 20 and latch 22 may be cast out of materials such as aluminum, steel or stainless steel. Alternately, the assembly may be welded up in certain applications. The operating bar 16 may be in one piece as shown or in two or more pieces if desired. Finally, this invention is not limited to use with bar locks for trailers, but can be used with a wide variety of doors, containers and panels.

It is therefore intended that the foregoing detailed description be regarded as illustrative rather than limiting, and that it be understood that it is the following claims, including all equivalents, which are intended to define the scope of this invention.

I claim:

1. A bar lock latch module comprising:
- a shaft having first and second ends;
- a bar lock latch located on the first end of the shaft;
- means, located on the second end of the shaft, for releasably coupling the shaft to an elongated bar such that rotation of the bar causes rotation of the shaft and the latch, said coupling means comprising a keyed portion configured to mate with a complementary keyed portion on the elongated bar; and
- a mounting bracket comprising:
  - a mounting plate shaped to be secured to a panel;
  - a bearing carried by the mounting plate and disposed around the shaft intermediate the two ends;
  - means for capturing the shaft in the bearing such that the shaft is free to rotate in the bearing but is prevented from moving axially out of the bearing; and
  - means for securing the mounting plate and the bearing in place on the shaft prior to installation of the bar lock latch module such that said shaft, latch, coupling means, and mounting bracket form a preassembled unit mountable on the panel as a single module to speed assembly of a bar lock comprising the module.

2. The invention of claim 1 wherein said mounting bracket further comprises a plurality of locating studs secured to the mounting plate to extend outwardly from the mounting plate on a side opposite the shaft.

3. The invention of claim 2 wherein the locating studs are threaded to receive mounting nuts to permanently secure the mounting bracket on a panel.

4. The invention of claim 1 wherein the coupling means comprises a socket sized to receive the bar and a rod that passes diametrically through the socket.

5. The invention of claim 1 wherein the coupling means comprises a socket sized to receive the bar and a ridge that passes diametrically across the socket.

6. The invention of claim 1 wherein the preassembled unit further comprises a handle and means for mounting the handle to the second end of the shaft.

7. The invention of claim 1 wherein the bearing comprises a bearing plate located on the mounting plate by the securing means.

8. The invention of claim 2 wherein the securing means comprises means for retaining the bearing plate on the locating studs.

9. The invention of claim 8 wherein the retaining means comprises a plurality of projections defined by the bearing plate to contact the locating studs and hold the bearing plate on the locating studs.

10. The invention of claim 1 wherein the latch comprises a cam.

11. The invention of claim 1 wherein the bearing comprises a bearing plate located adjacent the mounting plate, and wherein the securing means comprises a snap connection between the bearing plate and the mounting plate.

12. The invention of claim 1 wherein said mounting bracket further comprises at least one locating element secured to the mounting plate to extend outwardly from the mounting plate on a side opposite the shaft.

13. A method for assembling a portion of a bar lock on a panel comprising the following steps:

(a) providing an elongated bar comprising a complementary keyed portion on one end thereof;

(b) providing a bar lock latch module comprising:

a shaft having first and second ends;

a bar lock latch located on the first end of the shaft;

means, located on the second end of the shaft, for releasably coupling the shaft to the elongated bar such that rotation of the bar causes rotation of the shaft and the latch, said coupling means comprising a keyed portion configured to mate with the complementary keyed portion on the elongated bar;

a mounting bracket comprising:

a mounting plate shaped to be secured to a panel;

a bearing carried by the mounting plate and disposed around the shaft intermediate the two ends;

means for capturing the shaft in the bearing such that the shaft is free to rotate in the bearing but is prevented from moving axially out of the bearing;

means for securing the mounting plate and the bearing in place on the shaft prior to installation of the bar lock latch module such that said shaft, latch, coupling means, and mounting bracket form a preassembled unit mountable on the panel as a single module to speed assembly of a bar lock comprising the module;

(c) providing a plurality of fasteners;

(d) providing a panel having openings therein positioned to receive the fasteners;

(e) mounting the bar lock latch module in place on the panel as a unit by positioning the fasteners in the openings;

(f) interconnecting the keyed portion of the shaft with the complementary keyed portion of the elongated rod;

(g) securing the bar lock latch module in position on the panel.

14. The method of claim 13 wherein the fasteners are threaded, and wherein the securing step COmprises the step of threading nuts onto the fasteners to secure the bar lock latch module on the panel.

15. The method of claim 13 wherein step (e) is completed before step (f).

16. The method of claim 13 wherein step (f) is completed before step (e).

17. The method of claim 13 wherein the fasteners provided in step (c) comprise a plurality of locating elements secured to the mounting plate to extend outwardly from the mounting plate on a side opposite the 18. The method of claim 17 wherein the locating elements comprise threaded locating studs.

* * * * *